United States Patent [101]

Beischel et al.

[11] 4,052,819

[45] Oct. 11, 1977

[54] DOUBLE DOOR ASTRAGAL

[75] Inventors: Jerome K. Beischel, Cincinnati; William M. Bursk, Middletown, both of Ohio

[73] Assignee: Pease Company, Fairfield, Ohio

[21] Appl. No.: 764,899

[22] Filed: Jan. 17, 1977

[51] Int. Cl.[2] ..... E06B 7/16

[52] U.S. Cl. ..... 49/368; 49/394; 49/482; 49/494

[58] Field of Search ..... 49/368, 369, 367, 366, 49/394, 371, 494, 493, 476, 482

[56] References Cited

U.S. PATENT DOCUMENTS

| | | | |
|---|---|---|---|
| 3,649,060 | 3/1972 | Ruff | 49/368 X |
| 3,678,627 | 7/1972 | Dixon | 49/368 X |
| 3,768,422 | 10/1973 | Shaver et al. | 49/476 |

*Primary Examiner*—Philip C. Kannan
*Attorney, Agent, or Firm*—Biebel, French & Nauman

[57] ABSTRACT

A double door astragal is provided which comprises a rigid support member securable to the vertical edge portion of a normally inactive door, a rigid cover member securable in a plurality of positions relative to the rigid support member and mounted on the rigid support member with a U-shaped portion having an outer leg extending into the swinging path of the active door, and a flexible sealing member secured to the rigid support member and extending into the opening formed by the U-shaped portion of the cover member so as to contact the outside surface of the active door when the vertical edge portions of the active and inactive doors are in abutting relation, to provide an adjustable seal against weather.

11 Claims, 12 Drawing Figures

14
50
48
48
52

6
38
38
48
72
96
94
90
44
42
44
38
46
76
86
80
38
92
6

36
12
72
88
38
94
90
44
42
44
74
86
82
84
78
95
92
18

72
76
90
94
92

DOUBLE DOOR ASTRAGAL

BACKGROUND OF THE INVENTION

1. Field of the Invention

The present invention is directed to weather seals for external doorways, and more particularly, to an astragal for sealing between a set of double doors.

2. Prior Art

In order to seal the space between abutting vertical edge portions of double doors where one of the doors is normally inactive, it is common to use a T-shaped astragal mounted to the vertical edge portion of the inactive door with one side of the head of the T extending onto the outside front surface of the inactive door and the other side of the head portion of the T extending into the swinging path of the active door so as to act as a seal and stop when the active door is closed. It is also conventional to provide some flexible sealing elements on the side of the head of the T-shaped astragal which contacts the front surface of the active door, in order to provide a seal between the astragal and the active door.

Unfortunately, since double doors are seldom perfectly hung so that the doors are exactly aligned in a vertical plane or with the top and bottom edges in the same planes, the conventional type of T-shaped astragal does not always provide the seal against weather that it is intended to provide. For example, if the active and inactive doors are not in the same generally vertical plane, the conventional T-shaped astragal mounted to the inactive door will not contact the active door along its entire height as it is theoretically intended to do. Also, it is possible that the doors will be so far out of alignment that even the flexible sealing member will not contact the active door, thus defeating entirely the intended purpose of the astragal for sealing against weather conditions.

Double door installations are normally sealed along the hinge portion of the door and the upper edge adjacent the head jam, by a flexible sealing member which contacts the outer front surface of the doors when they are closed. Since the stop member attached to the head jam extends down over the upper surface of the door in order to hold the sealing strip in position, it is necessary to notch the astragal so that it does not interfere with the closing of the door by contacting the stop members. This generally produces an air gap between the astragal, the doors and the head stop in conventional installations.

In order to seal between the bottom edges of the doors and the sill, flexible sealing members are generally secured to the door or the sill so as to contact the bottom edge surface of the door if they are secured to the sill or to contact the top of the sill if they are secured to the door. Thus, unlike the other three sealing edges of the door the bottom edge seals in shear rather than in compression of the flexible sealing members.

In the case where the bottom sealing member is secured to the door, there will of necessity be a gap between the doors and the sill at the abutting vertical edge portions of the door, since the doors cannot in fact contact one another when closed. This, therefore, produces an air gap at the juncture of the doors and the sill.

Further, double door assemblies are generally provided with vertically extending lock pins which extend into the head jam and the sill adjacent the astragal on the inactive door in order to maintain the inactive door rigidly in the closed position. Since conventional lock pins are usually cylindrical and extend from the central portion of the door adjacent the astragal and do not contact any other surfaces than the corresponding holes in the head jam and sill they do nothing to help seal off the openings which exist due to interruption of the flexible sealing means as described above.

SUMMARY OF THE INVENTION

The present invention overcomes the difficulties and disadvantages associated with the prior art devices as discussed above, by providing a double door astragal assembly which can be adjusted into sealing engagement with the front surfaces of the active and inactive doors independently and regardless of misalignment of the doors in several different planes, and by providing a sealing construction associated with the lock pins at both the top and bottom of the inactive door, which engages the active door so as to seal at the juncture of the door frame and the two doors.

These advantages are accomplished by providing an astragal for use with a double door assembly in which a rigid support member is securable to a vertical edge portion of the inactive door and extends the entire height of the door in sealing engagement therewith, a rigid cover member also extending the height of the door and releasably securable to the rigid support member in a plurality of positions for engaging the vertical edge portion of the active door along its height when the doors are in abutting relation, and a flexible sealing member mounted on the cover member and disposed between the cover member and vertical edge portion of the active door for sealingly engaging along the height of the edge of the active door when the doors are in abutting relation.

The rigid cover member is preferably releasably secured to the support member with a plurality of generally horizontally disposed slots defined therein at spaced intervals along the length of the cover member in alignment with a plurality of corresponding holes in the rigid support member and securable in position with screws positioned in the holes with the head portions of the screws engageable with the edge portions of the slots to maintain the cover members in a desired position relative to the support member. The support member preferably has a general U-shaped cavity defined therein extending axially along the length of the support member for receiving a corresponding leg portion of the cover member in which the above referred to slots are defined.

The sealing member likewise has a leg portion which is inserted in the U-shaped cavity of the support member in engagement with the walls of the support member and the surfaces of the leg portion of the cover member so as to maintain the sealing member in frictional engagement between the support and cover members in the desired position so as to seal against the front surface of the active door. The sealing member may be adhesively secured to the cover member for movement therewith if desired.

The cover member preferably has a generally U-shaped portion extending along its length and extending into the swinging path of the active door with the end of the U-shaped portion of one of the legs engageable with the active door to act as a door stop when the doors are in abutting relation. The sealing member is preferably disposed with the sealing portion in the opening formed by the U-shaped portion of the cover member for compressible engagement with the outer front surface of the active door when it is closed.

Also, it is preferable to provide a sealing portion of the support member in engagement with the outer front surface of the inactive door with a U-shaped cavity facing the front surface of the door to act as a trough through which rain water forced between the support member and the door will be channeled downwardly to the bottom of the door. This eliminates the need for a sealing compound such as caulking compound to provide a water type seal between the astragal and the inactive door as is conventionally used.

A further preferred construction in accordance with the present invention provides a novel flush bolt locking mechanism. The flush bolt includes a rectangular portion having a width substantially equal to the thickness of the door and extending across the edge portion of the door adjacent the astragal and a small lock pin extending from the upper surface of the rectangular portion. Flexible sealing members are mounted to the rectangular portion of the flush bolt so that when the flush bolt is positioned in the locking position with the lock pin extended into the door frame, the rectangular member will abut the surface of the door frame and the flexible members will contact the active door and the inactive door so as to form a seal at both the top and bottom of the door between the active and inactive doors and the door frame.

DETAILED DESCRIPTION OF THE PREFRRED EMBODIMENT

Figure 1:
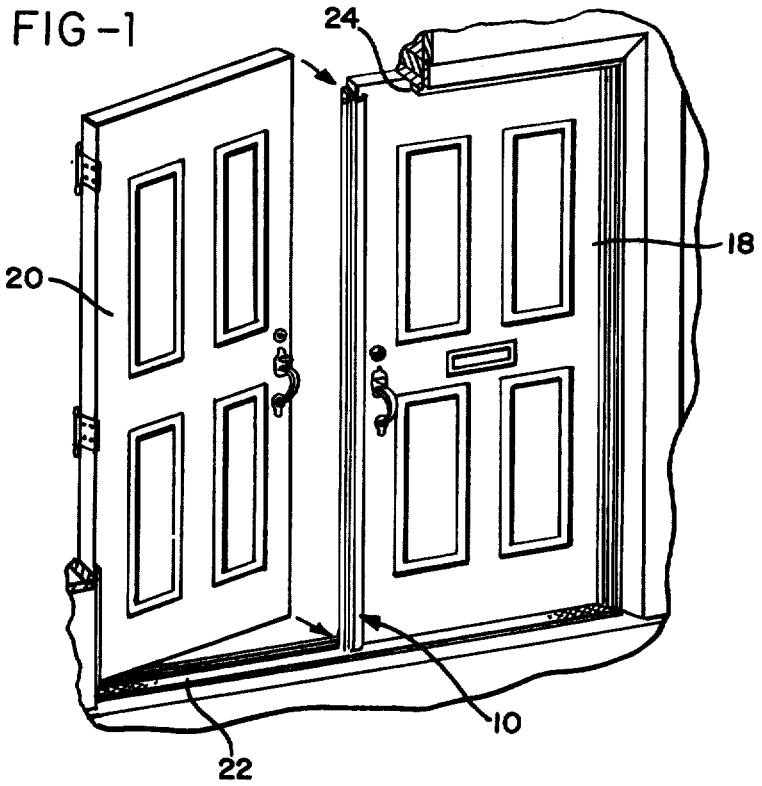
FIG. 1 is a pictorial view of a double door installation utilizing a preferred embodiment of the astragal of the present invention.
Figure 2:
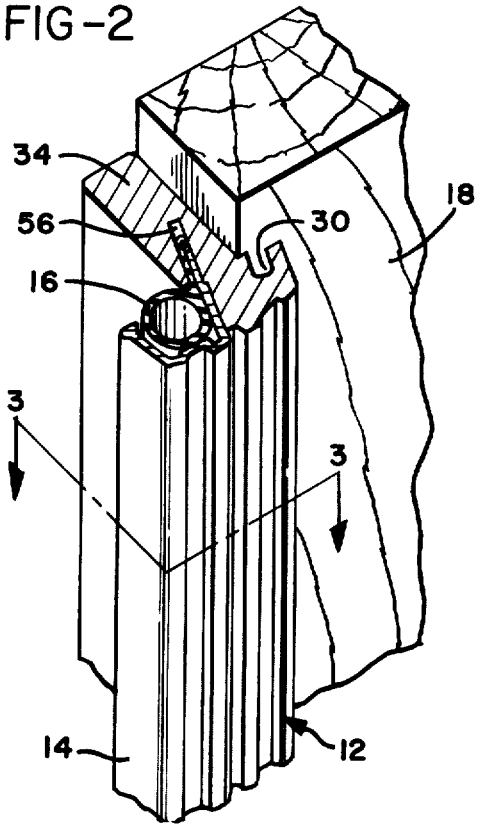
FIG. 2 is an expanded pictorial view of the preferred embodiment illustrated in FIG. 1.

The astragal assembly 10 of the preferred embodiment basically comprises three major components including a support member 12, a cover member 14 and a flexible sealing member 16, all of which are intended to be secured to the vertical edge portion of the inactive door 18 to provide a weather seal between it and the active door 20 as illustrated in FIG. 1. Astragal assembly 10 is intended to extend substantially the entire vertical height of the inactive door 18 between the sill 22 and head jam 24.

Figure 3:
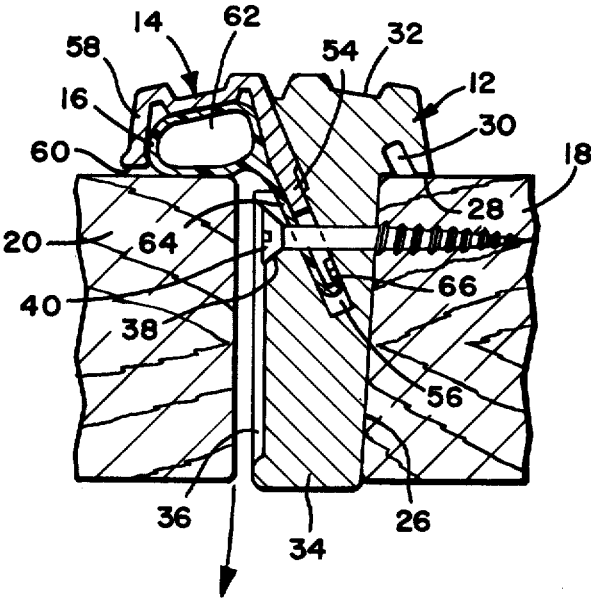
FIG. 3 is a cross sectional view through the astragal of the embodiment illustrated in FIG. 1.

The support member 12 secured to the inactive door 18, as shown in FIG. 3, has a flat surface 26 which lies along the outermost vertical surface of the edge portion of the inactive door, and has another flat surface 28 perpendicular to surface 26 and also extending the height of the vertical edge portion of the inactive door and engaged with the outer front surface of the door. Flat surface 28 has a generally U-shaped cavity 30 defined therein extending the entire vertical height of the support member 12.

Cavity 30 provides a trough or channel through which water forced between the front surface of the inactive door 18 and the flat surface 28 can flow down to the bottom of the door where it will drip onto the sill. This provides an effective water seal between the support member 12 and the front surface of the inactive door 18 which eliminates the need for use of a caulking material between the surface 28 and the inactive door 18 as is conventionally provided.

An outer portion 32 of support member 12 is provided with a contoured decorative surface of any desired form. The main body portion 34 of support member 12 has an outer surfce 36 which is contoured with a plurality of depressions for providing the strike plate, flush bolt openings and the holes for fastening the astragal assembly 10 to an inactive door, all of which are discussed in detail below.

Figures 4, 5, 6, 7:
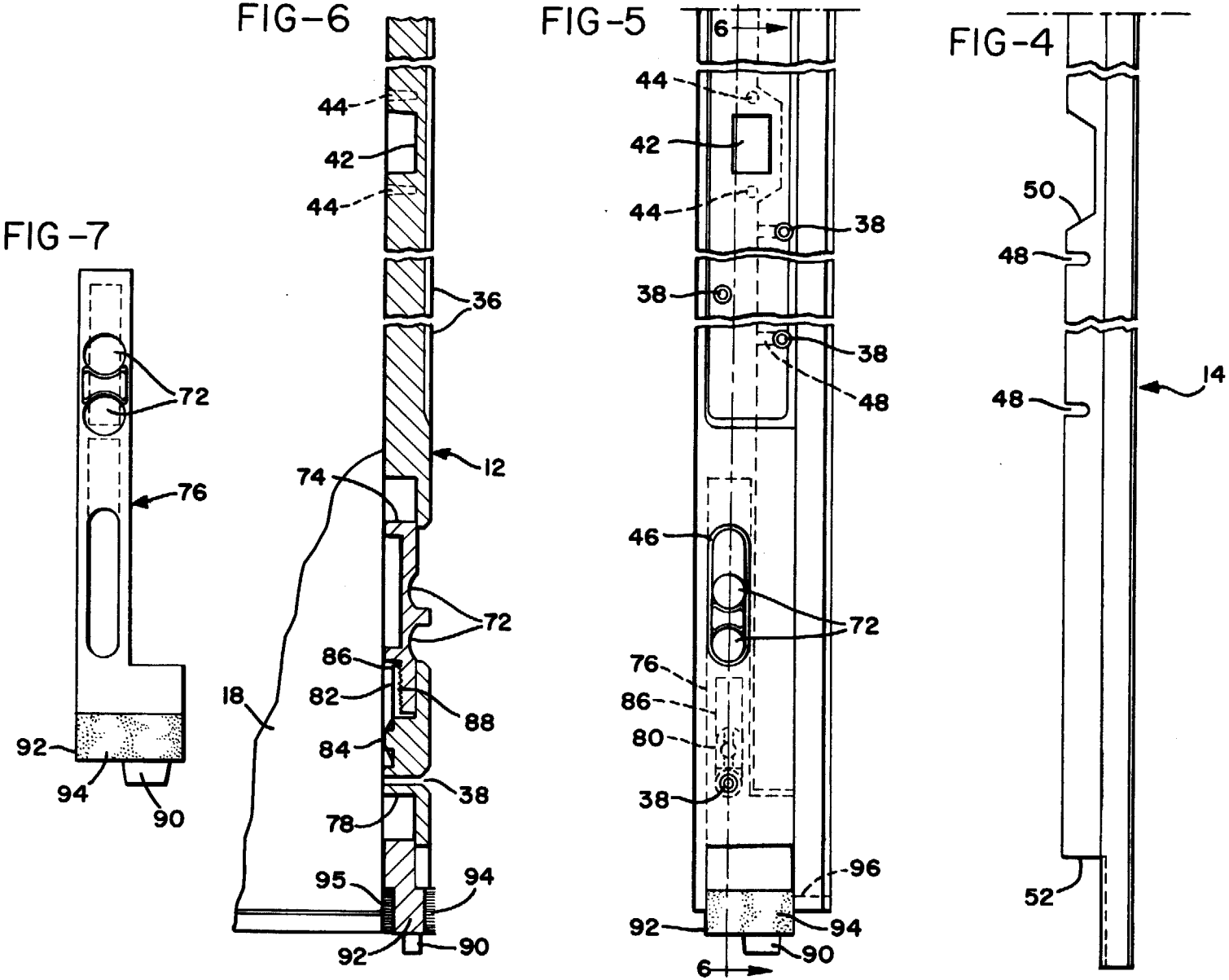
FIG. 4 is a side elevation of the cover member of the preferred embodiment in the position it would be in if secured to an inactive door with the outside of the door to the right.
FIG. 5 is a side elevation of the astragal assembly of the preferred embodiment looking toward the vertical edge of the inactive door with the outside of the door to the right.
FIG. 6 is a section on the line 6—6 of FIG. 5.
FIG. 7 is a side elevation of the flush bolt of the preferred embodiment of the present invention.

As best seen in FIGS. 3 and 5, a plurality of countersunk holes 38 are provided along the length of the support member 12 for receiving screws 40 to secure the astragal assembly 10 to the inactive door 18. Referring more particularly to FIGS. 5 and 6, support member 12 is provided with an easily removable membrane 42 at the location for a strike plate (not shown) to be positioned on the support member in alignment with the door latch (also not shown) on the active door 20. Since it is intended that the support member 12 can be utilized for either a right or left hand inactive door, two removable membranes 42 are provided at vertically spaced locations equidistant from the transverse center line of the support member 12. The latch on a door is normally positioned at a standard height less than half the vertical height of the door, and thus the two locations for securing a strike plate must be provided.

Membrane 42 is formed in any well known manner such as, for example, the provision of a relatively thin section of the material from which the support member is formed at the location of the strike plate, and possibly including a perforated boundary line which permits an individual to knock out the membrane 42 with relatively light force. Thus, the other membrane 42 which is not needed can remain in position maintaining the outer continuous surface of the support member. Also frustoconical cavities 44 are provided on each side of the membrane 42 with a small thickness of material remaining between the end of the cavities 44 and the upper surface of the support member 12 to provide material through which the screws to hold the strike plate may be inserted, but without the need for drilling through the entire thickness of the support member.

At each end of the support member 12 are elongated openings 46 through which a flush bolt can be operated as discussed in detail below. It should be noted that although only one end of the astragal assembly is illustrated in FIGS. 5 and 6, the opposite end is identical since it is intended, as mentioned above, that the support member 12 usable on either a right hand or left hand inactive door, which ever is desired, without modification of the support member or the need for two different support members.

Cover member 14 is best illustrated in FIG. 4, and has a plurality of slots 48 disposed in locations corresponding to holes 38 in support member 12. A cut-out 50 is provided at each location of membrane 42 and extends out beyond the frusto-conical cavities 44 so as not to interfere with the mounting of the strike plate. A further cut-out 52 is also provided on each end of cover member 14 so that it does not interfere with operation of the flush bolt as described below. Again, only one-half of the cover member 14 is shown in FIG. 4; the other half being identical about the transverse center line.

Referring more particularly to FIG. 3, the cover member 14 has a substantially uniform cross section along its length comprised of a leg portion 54 which mates with a corresponding slot 56 in support member 12, but with clearance provided between the walls of the slot and the surfaces of the leg portion 54 in order to permit insertion of the flexible sealing member 16 as described below. The leg portion 54 of cover member 14 extends from another portion of cover member 14 which has a generally U-shaped portion 58 including a leg portion 60 whose outermost end will engage the outer front surface of the active door 20 when aligned in abutting relation with inactive door 18.

Contained within the cavity formed in the U-shaped portion 58 of cover member 14 is the flexible sealing member 16. In the uncompressed position, i.e., with the active door open, member 16 extends beyond the outermost end of end portion 60 so that when the active door is closed, the sealing member will be compressed to seal against the outside surface of the door. Flexible sealing member 16 can be constructed in any known manner, but is here shown as a flexible rubber-like extrusion having a generally cylindrical body portion 62 which acts as the sealing member with the front surface of the active door. Alternatively, if the front surface of the door is still a magnetic sealing member 16 may be utilized with a flexable magnet (not shown) disposed in the body portion 62.

The leg portion 64 of sealing member 16 extends into the slot 56 in the support member 12 and wraps around the leg portion 54 of cover member 14 to be secured in position relative to the cover member. The leg portion may be adhesively adhered to the surface of the cover member 16 on both sides thereof, if desired, and a notch 66 is also provided in the lower end portion of cover member 16 to receive a corresponding portion on the leg portion 64 of flexible sealing member 16.

Referring now to the flush bolt assembly 70 which is best illustrated in FIGS. 5 and 6, a pair of indentations 72 are provided in the lower end portion 74 of a flush bolt member 76 in alignment with the elongated opening 46 in support member 12. One of the screws 40 is inserted in a hole 38 which has a cylindrical guide surface 78 molded into the back portion of the support member 12 adjacent the inactive door 18. The cylindrical guide surface 78 fits in a corresponding elongated opening 80 in bolt member 76 to serve as a guide for the vertical movement of the bolt member 76 along the support member 12.

As seen in FIG. 6, a leaf spring member 82 is secured to a post 84 formed on the back of the support member 12 with an outer end portion 86 formed in a turned up flange which matingly engages the serrated tooth-like portion formed on the back of bolt member 76 so as to hold the bolt member in any desired position along its path of vertical movement relative to the support member 12. The actual locking pin 90 extends from a rectangular end portion 92 of bolt member 76 which extends across the top of the support member 12 for a distance substantially equal to the thickness of the inactive door and substantially in alignment therewith.

Adhesively secured to opposite surfaces of rectangular end portion 92 of bolt member 76 are flexible cloth-like sealing members and 95 (commonly referred to in the trade as a "Schlegel" member). Member 94 extends beyond the outer surface of support member 12 opposite the side in contact with inactive door 18 and engages the edge portion of the active door 20 in a manner described in more detal below. Member 95 contacts the edge of the inactive door, also as described in more detail below.

Both the support member 12 and cover member 14 can be formed of any suitable substantially rigid material such as aluminum or plastic. Because of the required membranes and other structural features, however, the astragal parts can best be formed by molding which can be more easily accomplished with structural synthetic resins than with metals.

Referring now to the manner in which astragal assembly is utilized, the flexible sealing member 16 is fitted around the leg portion 64 of a cover member 14 and can be secured thereto with an adhesive if this is desired, so that the generally circular portion 62 is disposed in the U-shaped portion 58 of cover member 14 along its entire length. The cover member 14 is then inserted in the slot 56 in support member 12 along with the leg portion 64 of sealing member 16 so that the slots 48 in cover member 14 are aligned with holes 38 in support member 12.

Since, as mentioned above, the support member 12 is symetrical about a transverse center line perpendicular to its vertical extent, flush bolt assemblies for the top and botton must be mirror images of one another. If only a single flush bolt will be used, for example, for locking into the sill beneath the inactive door, it must be determined which door will be inactive, since the assembly must be up-ended one way or the other depending upon whether the right hand or left hand door is inactive. Thus, two mirror image flush bolt assemblies 70 must be available for installation.

Assuming that a single flush bolt assembly 70 will be utilized for installation of the astragal on a left hand inactive door as viewed looking out from the inside of the building, the assembly as shown in FIG. 5 can be considered as having the lock pin 90 fitting in a corresponding opening in the door still with the outside of the door to the right. The flush bolt assembly as shown in FIG. 7 is in the same position as in FIG. 5.

The distance from the sill to the stop on the head jamb 24 must then be measured adjacent the position of the inactive door, and the cover member 14 and flexible sealing member 16 must then be cut at the upper portion for example as shown by the dotted line 96 in FIG. 5, although it must be kept in mind that this will be in the upper end of the astragal assembly and not at the bottom. This permits the inactive door to rest flush against the seals around the upper portion and side edges of the door in a conventional manner.

The assembly is then secured in the inactive door, and screws 40 are inserted in holes 38, thus securing the astragal assembly to the outer edge of the inactive door.

The screws 40 will not be tightened completely since it is then necessary to align the cover member with the active door. This can best be accomplished by merely closing the active door and forcing the sealing member 16 (outer edge 60 of the cover member) against the outer surface of the active door for the entire height of the door. The door can then be opened and the screws 40 tightened so that the outer end 60 of the cover member 14 and the sealing member 16 will both rest exactly flush along the entire height of the outer surface of the active door 20.

Figure 9:
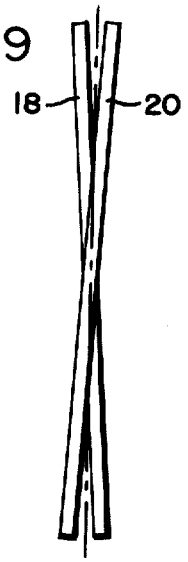

This ability to adjust the position of the cover member 14 relative to the support member 12 permits the astragal of the present invention to seal perfectly against the front surface of the active door, unlike conventional solid astragal members which necessarily leave some gap between the active door and the astragal outer surface which overlaps the active door, unless there is absolutely perfect alignment. Thus, the condition illustrated in FIG. 9 is compensated for by being able to move the cover member relative to the support member at an angle due to the movement of the slots 48 along screws 40.

Figure 8:
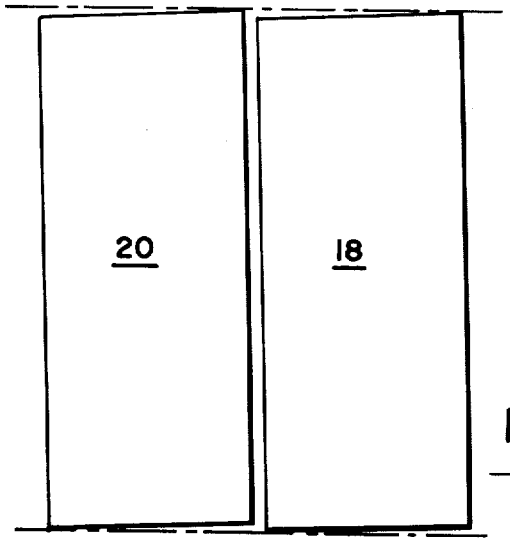
FIGS. 8 through 10 are schematic illustrations of several ways in which a double door assembly can be misaligned.
Figure 10:
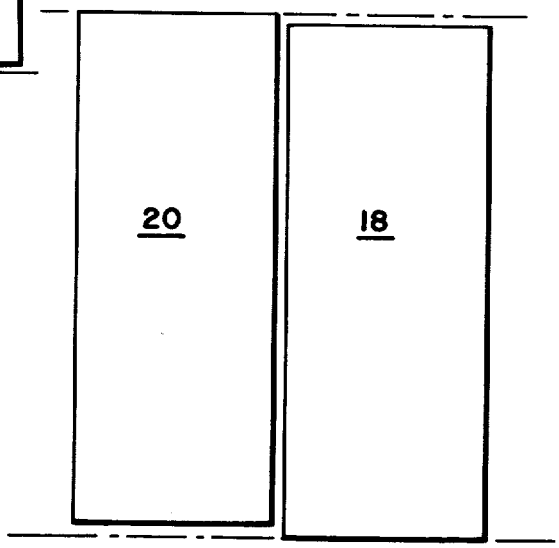

This is not the only misalignment condition which can exist in the installation of double doors, and therefore the novel flush bolt assembly 70 of the present invention is intended to assist in overcoming the effects of misalignment in the other two planes as illustrated in FIG. 8 and 10. The flush bolt assembly 70 seals the openings between the abutting edge portions of the doors at the top and bottom adjacent the frame. The misalignment which can occur along the bottom edges of the doors above the sills can be compensated for by using a sill of the type disclosed for example in U.S. pat. No. 3,900,967 assigned to the same assignee as the present invention, but which does not form a part of the present invention. The present invention is particularly useful when the flush bolt assembly is used adjacent the sill of the door frame to seal any opening which would otherwise occur there, since generally, the astragal is fairly tightly positioned against the door stop portion of the head jam, thus preventing a significant air gap at that end of the door.

Figure 11:
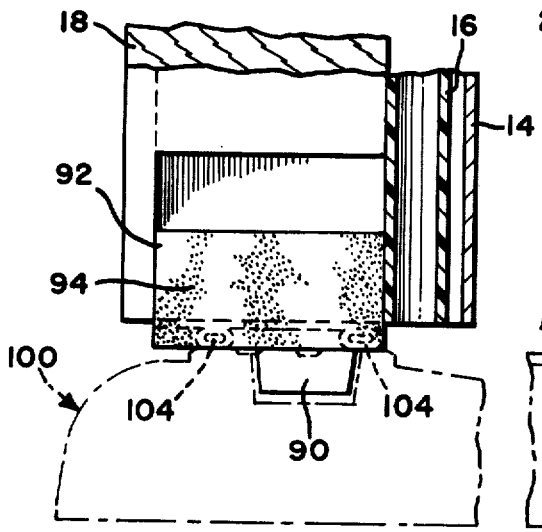
FIG. 11 is a partial vertical sectional view transverse to the door, of the flush bolt of the preferred embodiment positioned in a sill and taken on the line 11—11 of FIG. 12.
Figure 12:
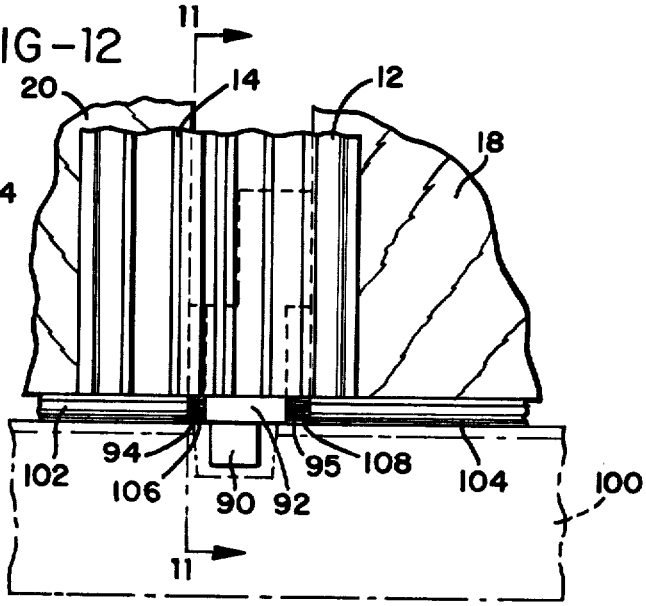
FIG. 12 is a partial vertical view taken at right angles to FIG. 11 and looking from right to left in FIG. 11.

Referring to FIGS. 10 and 11 which illustrate the relative position between the flush bolt assembly 70, doors 18 and 20 and sill 100, the present invention provides a means for completely sealing the juncture of the doors and the sill so as to prevent a significant air gap therebetween as is usually present in the prior art. At the bottom of doors 18 and 20 are sealing strips 102 and 104 secured to the doors and which seal between the doors and sill 100 in a conventional manner. In the embodiment shown, each of the seals 102 and 104 consists of a pair of generally cylindrical flexible members which are compressed on contact with the sill member to seal between the door and the sill.

Ends 106 and 108 of the sealing members 102 are cut off flush with the vertical edge portion of their respective door (as is the case with conventional constructions) and are engaged by the flexible cloth members 94 and 95 respectively.

Conventional constructions of flush bolts leave a rectangular opening between the sill and the bottom of the astragal through which substantial air flow can pass, thus decreasing the thermal efficiency of the door. This is because with conventional constructions, a flush bolt generally has a lock pin which is cylindrical and extends from the bottom surface of the door into the sill thus allowing air flow around the pin which does not inhibit air flow through the rectangular opening mentioned.

With the present construction, however, the rectangular end portion 92 of bolt member 76 extends from the bottom of the astragal onto the top surface of the sill when lock pin 90 is extended into the corresponding opening in the sill. The flexible sealing member 95 on the back surface of rectangular portion 92 abuts the end 108 of sealing member 104 to provide an efficient thermal barrier. On the opposite side of rectangular portion 92, the flexible cloth-like sealing member 94 extends to contact the end 106 of sealing member 102 and the vertical edge portion of active door 20, providing an efficient seal on that side of the rectangular member. Thus, it can be seen that the entire rectangular opening which is generally present in conventional construction is thereby sealed by the present invention to prevent significant air flow therethrough.

Although the foregoing illustrates the preferred embodiment of the present invention, other variations are possible. All such variations as would be obvious to one skilled in this art, are intended to be included within the scope of the invention as defined by the following claims.

What is claimed is:

1. An astragal for use with a double door installation including an active door and an inactive door having substantially abutting generally vertical edge portions, comprising:

rigid support means securable to said vertical edge portion of said inactive door and extending substantially the entire height of said door for sealingly engaging said door;

rigid cover means extending for substantially the entie length of said support means and releasably securable to said rigid support means in a plurality of positions for engaging said vertical edge portion of said active door along its height when said doors are in abutting relation; and flexible sealing means mounted on said cover means and disposed between said cover means and said vertical edge portion of said active door for sealingly engaging substantially the entire height of said edge portion of said active door when in said abutting relation.

2. An astragal as defined in claim 1 wherein said rigid cover means is releasably secured to said rigid support means with a plurality of generally horizontally disposed slots defined therein along the length thereof in alignment with a plurality of corresponding holes in said rigid support means, and screws securable in said holes with head portions engageable with edge portions of said slots to maintain said cover means in a desired position relative to said support means.

3. An astragal as defined in claim 1 wherein said support means defines a slot therein extending axially along the length thereof for receiving a corresponding leg portion of said cover means.

4. An astragal as defined in claim 3 wherein said sealing means has a leg portion inserted in said slot in engagement with at least one wall thereof and with at least one surface of said cover means leg portion in frictional engagement therewith so as to maintain said sealing means in a desired position.

5. An astragal as defined in claim 4 wherein said cover means has a generally U-shaped portion extending along the length thereof and extending into the swinging path of said active door with one leg thereof engageable with said active door when said doors are in said abutting relation, said sealing means having a sealing portion disposed in the opening formed by said U-shaped portion of said cover means and compressively engageable with said active door when in said abutting relation.

6. An astragal as defined in claim 5 wherein said support means has a sealing portion in engagement with an outside front surface portion of said inactive door and extending the length of said support means, said sealing portion having a generally U-shaped cavity defined therein adjacent said front surface portion and forming a trough through which rain water forced between said support means and said door will be channeled downwardly to the bottom of said door.

7. An astragal as defined in claim 1 and further including a flush bolt means slideably mounted in said support means and vertically extendable into locking engagement with a horizontal portion of a door frame for releasably locking said inactive door in said abutting relation.

8. An astragal as defined in claim 7 wherein said flush bolt means includes:

a rectangular end portion slidably engaged in said support means and having a vertically extending pin protruding from an outermost surface of said rectangular portion and engageable with a corresponding opening in said door frame for holding said door in said abutting relation, said flush bolt means being movable between an unlocked position wherein said pin is disengaged from said corresponding hole and said inactive door is free to swing on its hinges and a locked position in which said pin is engaged in said corresponding hole so as to prevent said inactive door from moving from said abutting position; and sealing means secured to a vertical side surface of said rectangular portion of said flush bolt means and engageable with said vertical edge portion of said active door at a position where it will seal between said active door and said door frame.

9. an astragal as defined in claim 8 wherein said sealing means comprises a flexible cloth-like strip capable of forming an air barrier between said edge portion of said acttive door and said door frame.

10. An astragal as defined in claim 8 wherein a second sealing means is secured to another vertical side surface of said rectangular portion of said flush bolt means opposite said first mentioned vertical side surface thereof, and engageable with the vertical edge portion of said inactive door at a position where it will seal between said inactive door and said door frame.

11. An astragal as defined in claim 10 wherein said second sealing means comprises a flexible cloth-like strip capable of forming an air barrier between said edge portion of said inactive door and said door frame.

* * * * *